United States Patent [19]

Davis et al.

[11] B 3,997,648

[45] Dec. 14, 1976

[54] FIBRIL FORMATION PROCESS

[75] Inventors: Joseph Calvin Davis, DeSoto; Francis Ross Galiano, Overland Park; Robert William Hill, Leawood, all of Kans.

[73] Assignee: Gulf Research & Development Company, Pittsburgh, Pa.

[22] Filed: Jan. 3, 1972

[21] Appl. No.: 214,925

[44] Published under the second Trial Voluntary Protest Program on March 9, 1976 as document No. B 214,925.

[52] U.S. Cl. ..... 264/140; 162/157 R; 260/94.9 F; 264/5; 264/8; 264/205; 528/502; 526/348; 526/352

[51] Int. Cl.[2] ..... B02C 18/00

[58] Field of Search ..... 264/5, 9, 8, 205, 140; 260/94.9 F; 162/157 R

[56] References Cited

UNITED STATES PATENTS

| | | | |
|---|---|---|---|
| 3,058,971 | 10/1962 | Miller et al. | 260/94.6 F |
| 3,244,688 | 4/1966 | Goins | 260/94.6 F |
| 3,308,211 | 3/1967 | Plastridge | 264/9 |
| 3,372,154 | 3/1968 | Turner et al. | 260/94.9 F |
| 3,432,579 | 3/1969 | Zavasnik | 264/5 |
| 3,468,986 | 9/1969 | Watanabe | 264/9 |
| 3,563,885 | 2/1971 | Talbot | 210/54 |
| 3,655,829 | 4/1972 | Ronzoni et al. | 264/171 |

*Primary Examiner*—Jay H. Woo
*Attorney, Agent, or Firm*—Richard L. Kelly

[57] ABSTRACT

An improvement in the fibril formation process which includes dissolving at an elevated temperature an olefin polymer having an inherent viscosity of at least 3.5 in a hot hydrocarbon solvent, shearing the hot polyolefin solution to thereby orient the polymer molecules therein, passing the sheared solution through a cooling zone maintained at a temperature well below the precipitation temperature of the solution while maintaining the orientation of the polymer molecules within the solution to thereby precipitate by thermal means the polymer solute of the solution in the form of a solvent swollen fibrous strand, separating a substantial portion of the polymer solvent from the fibrous strand, chopping and then beating the chopped fibrous strand in a liquid which is a nonsolvent for the polymer and which is soluble in the polymer solvent for a time sufficient to break down the fibrous strand into a plurality of fibrils, and separating the fibrils from the nonsolvent liquid. The improvement consists of homogenizing the hot polyolefin/hydrocarbon solvent solution by passing same through a device, such as a gear pump, which imposes a high shear on the solution to thereby remove any small, invisible globules of partially dissolved polyolefin that may be present in the solution prior to the fibril formation steps of the process whereby paper sheets fabricated from the resultant fibrils are free of small knots and lumps and possess a completely smooth surface.

2 Claims, 1 Drawing Figure

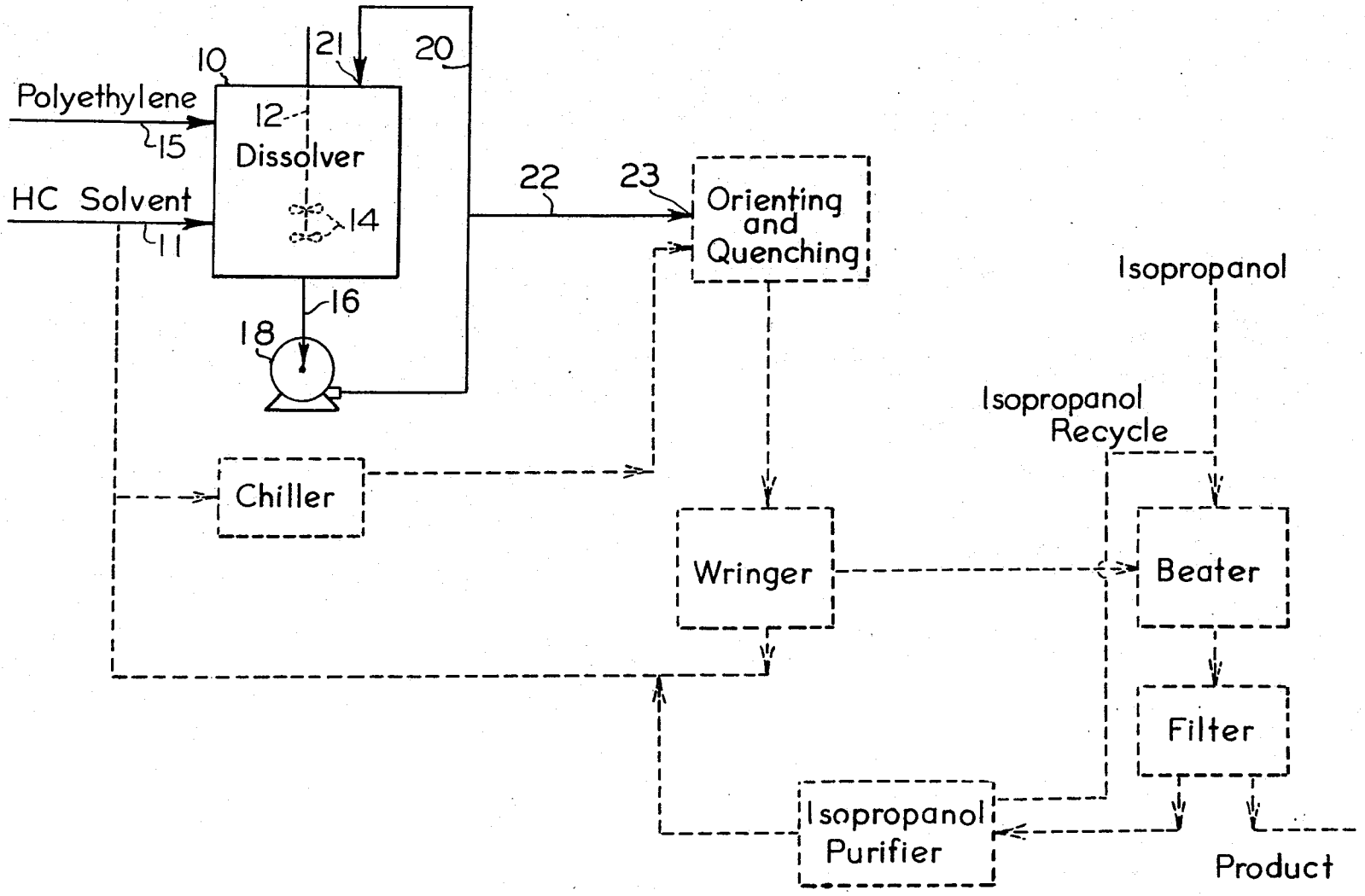
Polyethylene
HC Solvent
15
11
10
12
Dissolver
14
21
20
22
23
16
18
Orienting and Quenching
Chiller
Wringer
Isopropanol
Isopropanol Recycle
Beater
Filter
Product
Isopropanol Purifier

FIBRIL FORMATION PROCESS

BACKGROUND OF THE INVENTION

1. Field of the Invention

This invention relates to an improvement in the process for the formation of fibrils from high molecular weight polymers. More particularly, the subject invention pertains to an improvement in the method of making fibrils from high molecular weight polyolefins, in particular polyethylenes and polypropylenes, whereby the resulting paper on other sheet-like structures into which these fibrils or fibril material are incorporated are improved. The fibrils produced by this invention, and particularly when produced employing the improvement in the process thereof, are capable of forming coherent self-supporting water leaves which can be used for the production of sheet-like structures according to known methods of paper manufacturing which are of improved quality.

2. Description of the Prior Art

In Davis et al, Ser. No. 193,716, filed Oct. 29, 1971, entitled "Improved Fibril and Process"; Davis et al, Ser. No. 202,302, filed Nov. 26, 1971, entitled "Improved Fibril Process"; and Davis et al, Ser. No. 211,562, filed Dec. 23, 1971, entitled "Fibril Process", there has been disclosed a number of processes for producing high quality fibrils which are especially suitable for and readily adaptable to incorporation into paper or other sheet-like structures which are manufactured by the known paper-making processes. The invention disclosed herein is an improvement in those processes.

In each of these previously mentioned inventions, the fibrils are produced from a solution of a very high molecular weight polyolefin, particularly polyethylene or polypropylene, in which the solution is sheared or subjected to a shearing action whereby the polymer molecules therein are oriented and immediately thereafter the polymer solute is made to precipitate from the solution by purely thermal means, which is attained by rapidly lowering the temperature, as in a quenching bath or by other cooling means. As has been previously disclosed, the most useful systems for this type of fibril production are those systems employing polyolefins and suitable liquid hydrocarbon solvents for these polyolefins. The cooling or quenching of these oriented solutions is usually carried out under conditions of zero shear and at temperatures well below the precipitation temperatures of the polymer solutions to result in the formation of solvent swollen fibrous masses. The solvent swollen fibrous masses are then normally converted into fibrils by a series of subsequent operations which usually include the removal of excess solvent from the fibrous mass, the cutting of the fibrous mass into pieces of desired length, and the beating and refining of the cut or chopped fibrous mass into individual fibrils for use in the production of paper or other sheet-like materials on paper-making machinery by the methods normally employed in the production of paper.

While the paper hand sheets fabricated in each of the hereinabove identified disclosures from a plurality of the fibrils produced by the process of each of the respective inventions were of good quality, it was observed that some of the sheet-like structures were not completely smooth. Those paper hand sheets which were not completely smooth seemed to contain small, miniscule knot-like lumps of varying sizes that protruded from the surface of the sheet. This condition, i.e., containing small lumps or knots of various sizes, was more visually apparent upon holding the paper hand sheets up to a strong light and observing the same. It was then hypothesized that the lumps or knots in the resultant paper sheets were caused by particles of incompletely dissolved polymer in the starting polymer solution from which the fibrils were obtained. Therefore, the original or starting polyolefin/hydrocarbon solvent solutions from which the fibrils were produced were checked and examined prior to the beginning of the fibril formation process. This examination did not result in an apparent answer or give any clear-cut evidence as to the fact that undissolved polymer might be present in the solutions and result or eventually show up as knots or lumps in the paper hand sheets fabricated from the fibrils produced from the polymer solutions.

SUMMARY OF THE INVENTION

We have found that paper hand sheets or other sheet-like structures of a higher and an improved quality over those paper sheets fabricated in the hereinabove identified disclosures can be produced if the starting hot polyolefin/hydrocarbon solvent solution, from which the fibrils that are to be incorporated into the paper sheets are formed, is first passed or circulated through a device that imposes a high shear on the solution prior to the fibril formation steps of the process. By incorporating this additional step and improvement in the fibril formation process, that being the passing of the polymer solution from which the fibrils are formed through a device imposing a high shear thereon, paper sheets can be fabricated from the resultant fibrils which are free of knots and lumps and possess a completely smooth surface. This homogenizing step in the fibril producing process is best accomplished by passing the polymer solution, prior to orientation thereof, through a gear pump, such as a Viking or Zenith pump, or other like device imposing a high shear on the liquid, to insure that there are no small, invisible globules of partially dissolved polymer present in the solution prior to formation of fibrils therefrom. The hot polyolefin/hydrocarbon solvent solution should be passed through the device imposing high shear thereon at least once and may be circulated therethrough any number of times or continuously as may be desired, until the solution is transported to the next step in the fibril formation process. An additional and unexpected advantage of employing this improvement and additional step in the fibril formation process is that by incorporating a device which imposes high shear on the polymer solution, such as a gear pump, it is possible to employ in the fibril formation process solutions of much higher viscosity. Consequently, when solutions of higher viscosity are employed, the requirements as to the large volumes of solvent used are enormously reduced as well as the size requirements of the vessels used in handling the polymer solutions.

BRIEF DESCRIPTION OF THE DRAWING

The novel features which are believed to be characteristic of this invention are set forth with particularity in the appended claims. The invention itself, however, both as to its organization and method of operation together with further objects and advantages thereof may best be understood by reference to the following description taken in connection with the accompanying drawing in which:

FIG. 1 is a flow diagram showing in solid lines the improvement step in the fibril formation process, the remainder of the method steps of the fibril formation process being shown in phantom lines.

DETAILED DESCRIPTION

The improvement of this invention in the process or method for the formation of fibrils, which are readily incorporable into the paper-making process for the formation of paper sheets of improved quality which are free of small knots and lumps and possess a completely smooth surface, consists essentially of homogenizing the hot viscous polyolefin/hydrocarbon solvent solution prior to the formation of fibrils therefrom. This homogenizing step is best attained by passing the hot polymer solution through a device, such as a gear pump, which imposes a high shear on the solution.

In order that the complete fibril formation process and the method of fabrication of paper sheets therefrom is completely and readily understood, the disclosure of Davis et al, Ser. No. 193,716 (more completely identified hereinabove) is incorporated herein by reference.

Referring to the drawing in detail now, the step required to carry out the improvement of the invention in the process or method of obtaining fibrils from a hot viscous polymer solution, which are capable of and particularly suitable for and useful in the production of paper sheets on paper-making machinery, is illustrated therein. The process and the improvement therein of this invention is initiated by first dissolving a polymer from which the fibrils are to be formed in a dissolver or vessel 10, the contents of which are stirred or agitated by a stirrer 12 having attached paddles or blades 14 adjacent its lower end and rotated by a motor (not shown) external to dissolver 10. The solvent employed and contained within vessel 10 in which the polymer is to be dissolved should be as described in Ser. No. 193,716 (identified in greater detail hereinabove). This solvent enters the dissolver or vessel 10 through solvent supply line 11 from a suitable source of solvent supply, and is usually preheated to approximately 135° C. The polymer which is to be dissolved within the hot solvent within vessel 10 is a high molecular weight polymer, more particularly a polyolefin, such as a polyethylene or polypropylene, and is more particularly set forth and defined in Ser. No. 193,716. The olefin polymer, particularly polyethylene or polypropylene, is fed into vessel 10 through a polymer fill line 15 from a suitable source of polymer supply. The method or process steps of the fibril formation process up to this point are the same as those set forth in the hereinabove identified disclosures relating to the production of fibrils. However, from this point forward there is a significant change in the method steps or process of the invention disclosed herein as compared to the processes set forth in the above-identified disclosures. It is this difference and improvement in the fibril process which constitutes the invention of this disclosure.

After the polymer solution, having the desired weight percent solids therein and having the desired viscosity (all as explained more fully in the disclosure of Ser. No. 193,716), has been obtained within dissolver 10, the same exits the bottom thereof into a flow line 16 which has its other end connected to a device 18, such as a gear pump, which is capable of imposing a high shear on the liquid solution. The polymer solution exiting dissolver 10 through flow line 16 is then passed or circulated through shear imposing device 18, which has its outlet connected to an exit or discharge flow line 20. The polymer solution after being sheared within device 18 passes through exit flow line 20 and is recirculated into dissolver 10, as indicated by arrow 21. As has been stated, shear imposing device 18 may be a gear pump, and more preferably is a Zenith or a Viking pump, through which the viscous polymer solution is passed or circulated from dissolver 10 through flow line 16 and then back to dissolver 10 through flow line 20. In order to obtain the advantages of this improvement in the fibril formation process, the hot polymer solution need pass through shear imposing device 18 only once, but greater improvements and results are attained if the polymer solution is passed through shear imposing device 18 more than once. If desired, the polymer solution obtained within dissolver or vessel 10 may be continuously circulated through shear imposing device 18 for some length of time or until it is desired to proceed with the remainder of the fibril formation process.

Apparently, shear imposing device 18 homogenizes and further dissolves those small, invisible globules of partially dissolved polymer that are present in the polymer solution as the same is passed or circulated through device 18. Therefore, the papers produced from the fibrils which have been formed from homogenized solutions are free of knots and lumps and have a completely smooth surface. By employing device 18, such as a gear pump, which imposes high shear on the polymer solution, it is possible to employ in the fibril formation process solutions of substantially higher viscosity. When solutions of high viscosity are employed in the fibril formation process, the enormous volumes of solvents normally required can be substantially reduced and the size of the vessels needed to handle the large volumes of polymer solutions can likewise be reduced.

When it is desired to proceed with the remainder of the fibril formation process, the hot polymer solution after being passed or circulated through shear imposing device 18 exits the same through discharge flow line 20 and is diverted by a valve or other like means (not shown) into flow line 22 and flows therethrough in the direction of arrow 23 to the remaining steps in the fibril formation process. The first of these remaining steps is normally an orienting step which is followed by a quenching step, all as more fully explained in the hereinabove identified disclosures relating to fibril formation processes.

In order to illustrate this invention and the improvement in the fibril formation process with greater particularity, the following specific examples are included. They are intended to be illustrative only and are not intended to limit the invention in any way.

EXAMPLE 1

In this example, fibrils were produced by the process set forth in Ser. No. 193,716 (more completely identified hereinabove) without employing the improvement of this invention in that fibril formation process. The resultant fibrils were used to fabricate a paper hand sheet on the Noble and Wood sheet-forming machine as described in Example 1 of Ser. No. 193,716.

Dissolver vessel 10 was charged with 150 parts of the substantially aliphatic hydrocarbon solvent Speedsol (boiling range 155°–180° C.) containing 0.011 parts of an anti-oxidant mixture consisting of equal parts by weight of Ionol, Santonox R (trademarks), and dilauryl thiodipropionate. To this solvent/anti-oxidant mixture was added 2.25 parts of a linear high molecular weight polyethylene having an inherent viscosity of 13.33 measured at a concentration of 0.05 g./100 ml. of decalin at 135° C. The slurry was then heated to 150° C. with stirring over a 2 hour period and then held at that temperature with stirring (by means of stirrer 12, see FIG. 1) for an additional period of 4 hours to dissolve the polyethylene, resulting in a solution containing about 1.5 weight percent polyethylene and having a viscosity of 4.200 centipoises (at 145° C.). This solution was then charged into a centrifugal spinning apparatus, such as the hammermill shown at reference numeral 22 in Ser. No. 193,716. Fibrils were then produced by carrying out the remainder of the method steps set forth in the process of Ser. No. 193,716 and a paper hand sheet was obtained on the Noble and Wood sheet-forming machine as set forth in the disclosure of said serial number. The resultant paper hand sheet, although strong, was observed to possess a surface which was not completely smooth. Upon holding the paper hand sheet up to a strong light, it was observed that the same contained small lumps or knots of polymer which imparted a certain roughness to the surface of the paper sheet.

EXAMPLE 2

In this example, fibrils were formed by the process set forth in Ser. No. 193,716 employing the improvement of this invention and a paper hand sheet was then fabricated from these fibrils.

The apparatus employed in this example was similar to that used in Example 1 with the exception that a Viking gear pump 18 was attached to exit flow line 16 of dissolver vessel 10 such that the polymer slurry or solution could be either circulated via flow line 20 in the direction of arrow 21 back into the dissolver or pumped out of the dissolver via flow line 22 in the direction of arrow 23 into a centrifugal spinning device. The apparatus was rigged so that, if desired, both operations could be carried on simultaneously.

The identical materials as those used in Example 1 and in the same proportions were charged to dissolver vessel 10 and were continuously stirred therein by stirrer 12. As soon as the heating was started, circulation of the slurry through Viking gear pump 18 and back into dissolver vessel 10 was begun. The polymer slurry was heated to 150° C. and circulated over a 2 hour period. After this period, a sample of the hot viscous polymer solution was pumped into the centrifugal spinning apparatus and the remainder of the method steps of the fibril formation process were carried out as in Example 1. At the same time that this first sample of polymer solution was pumped to the centrifugal spinning apparatus, the remainder of the polymer solution was pumped back into dissolver 10 and circulation from dissolver 10 through gear pump 18 and back to dissolver 10 was continued. Additional samples of polymer solution were taken for 10 minute periods each hour in the above-described manner while recirculation in each instance of the remainder of the polymer solution was continued. In each case and with each sample, the remainder of the method steps of the fibril formation process (Ser. No. 193,716) were carried out as in Example 1. A paper hand sheet was then fabricated in each case and for each polymer solution sample on the Noble and Wood sheet-forming machine as was done in Example 1.

The resultant paper hand sheet prepared from the fibrils obtained from the first polymer solution sample has a rough surface texture and contained numerous small knots and lumps of polymer similar to that noted or observed in the paper hand sheet obtained in Example 1. The paper sheet produced from the fibrils obtained from the second sample of polymer solution had considerably better surface characteristics with fewer small lumps and knots being observed therein. The paper hand sheet made from the fibrils produced from the third sample of polymer solution was observed to be substantially free of the previously noted small knots or lumps and possessed a smooth surface which was substantially free of any roughness.

While only certain preferred embodiments of this invention have been shown and described by way of illustration, many modifications will occur to those skilled in the art and it is, therefore, desired that it be understood that it is intended in the appended claims to cover all such modifications as fall within the true spirit and scope of this invention.

What is claimed as new and desired to secure by Letters Patent of the United States is:

1. In a process for producing fibrils from a high molecular weight polymer which are readily suitable for incorporation in the paper-making process, including the steps of dissolving at an elevated temperature an olefin polymer having an inherent viscosity of at least 3.5 in a hot hydrocarbon solvent to obtain a hot polyolefin solution, shearing the hot polyolefin solution to thereby orient the polymer molecules therein, passing the sheared solution through a cooling zone maintained at a temperature well below the precipitation temperature of the solution while maintaining the orientation of the polymer molecules within the solution to thereby precipitate by thermal means the polymer solute of the solution in the form of a solvent swollen fibrous strand, separating a substantial portion of the polymer solvent from the fibrous strand, chopping and then beating the chopped fibrous strand in a liquid which is a nonsolvent for the polymer and which is soluble in the polymer solvent for a time sufficient to break down the fibrous strand into a plurality of fibrils, and separating the fibrils from the nonsolvent liquid, the improvement consisting of the step of homogenizing said hot polyolefin/hydrocarbon solvent solution by passing said hot polyolefin/hydrocarbon solvent solution through a device imposing a high shear on said solution to thereby remove any small, invisible globules of partially dissolved polyolefin that may be present in said solution prior to the fibril formation steps of the process whereby paper sheets fabricated from the resultant fibrils are free of small knots and lumps and possess a completely smooth surface.

2. In a process as defined in claim 1 wherein said device for imposing a high shear on the hot polyolefin/hydrocarbon solvent solution is a gear pump.

* * * * *